United States Patent [19]

McLaughlin et al.

[11] 4,177,437

[45] Dec. 4, 1979

[54] HIGH POWER PRE-TR SWITCH

[75] Inventors: James F. McLaughlin, Severna Park; Harry Goldie, Randallstown, both of Md.

[73] Assignee: The United States of America as represented by the Secretary of the Air Force, Washington, D.C.

[21] Appl. No.: 871,066

[22] Filed: Jan. 20, 1978

[51] Int. Cl.² ..... H01P 1/14

[52] U.S. Cl. ..... 333/13; 313/221; 315/111.2

[58] Field of Search ..... 333/13; 313/180, 221, 313/222, 229, 231.3, 480; 315/39, 111.2

[56] References Cited

U.S. PATENT DOCUMENTS

| | | | |
|---|---|---|---|
| 3,219,868 | 11/1965 | Mason et al. | 313/221 X |
| 3,497,833 | 2/1970 | Goldie et al. | 333/13 |
| 3,648,100 | 3/1972 | Goldie et al. | 315/39 |
| 3,705,319 | 12/1972 | Goldie et al. | 333/13 X |
| 3,753,158 | 8/1973 | Prescott | 333/13 |
| 4,120,808 | 10/1978 | Byrum, Jr. et al. | 313/221 X |

*Primary Examiner*—Paul L. Gensler

*Attorney, Agent, or Firm*—Joseph E. Rusz; George Fine

[57] ABSTRACT

A high power pre-TR switch utilizes hot pressed boron nitride to form a vial. The vial contains a halogen gas such as chlorine.

1 Claim, 1 Drawing Figure

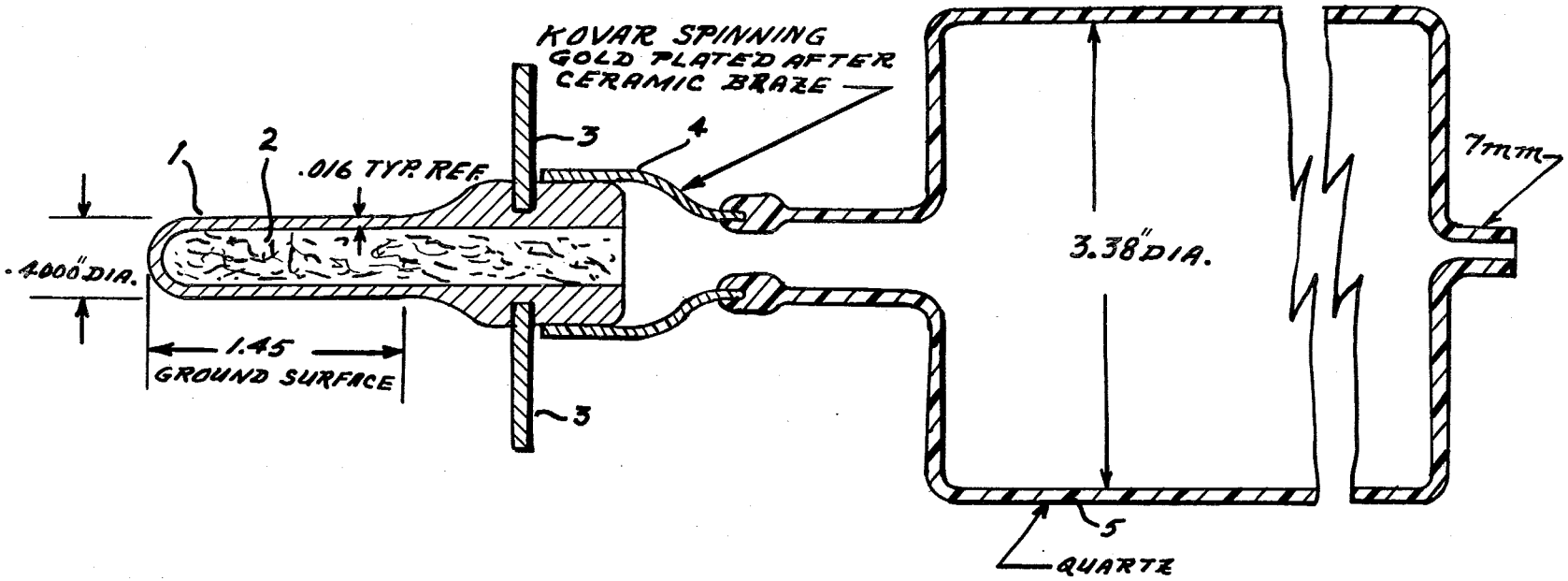
7mm
3.38" DIA.
5
QUARTZ
KOVAR SPINNING
GOLD PLATED AFTER
CERAMIC BRAZE
4
3
3
.016 TYP. REF.
2
1
1.45
GROUND SURFACE
.400" DIA.

HIGH POWER PRE-TR SWITCH

STATEMENT OF GOVERNMENT INTEREST

The invention described herein may be manufactured an used by or for the Government for governmental purposes without the payment of any royalty thereon.

BACKGROUND OF THE INVENTION

Modern day, high power radars require receiver protection (RP) that can handle hundreds of watts overage and still provide recovery times in the fractional microsecond range. These requirements are usually met by the RF by incorporating a pre-TR stage in the overall design. This stage is typically a sealed quartz vial, containing a halogen gas, such as chlorine installed in an aluminum mount that incorporates an appropriate iris. One serious limitation for high power systems is that these types of pre-TR designs are power limited due to the quartz temperature in the area of the plasma discharge. The poor thermal conductivity of quartz prevents thermal equilibrium from being achieved. The quartz temperature in the discharge area is considerably higher than that measured on the end of the vial. These extreme temperatures eventually result in the vial losing its vacuum integrity, and therefore, result in a catastrophic failure of the receiver protector. The receiver protector failure then results in a serious damage to the sensitive radar receiver, in particular, the expensive pre-amplifier stage. A second failure mechanism of these quartz type pre-TR's is the longer term gas cleanup phenomenon. This results in a more gradual type of receiver protector failure. The gas cleanup is basically a result of the energetic ions, generated in the RF induced plasma, striking the quartz surface and diffusing into the material. Some of these ions will diffuse deep enough to be permanently trapped. This activated diffusion then results in gas cleanup. The cleanup rate is proportional to the square root of the diffusion coefficient of chlorine into quartz. A different vial material would result in a different diffusion rate for the same gas. The present invention solves both the thermal problem and the gas cleanup.

SUMMARY OF THE INVENTION

A higher power TR switch is provided. The TR includes a vial housing a halogen gas such as chlorine. The vial is comprised of hot pressed boron nitride which eliminates the associated thermal problem and also the gas cleanup problem.

DESCRIPTION OF THE DRAWING

The single FIGURE represents a preferred embodiment of the high power TR switch.

DESCRIPTION OF THE PREFERRED EMBODIMENT

In the single FIGURE of the preferred embodiment there is shown vial 1 consisting of hot pressed boron nitride material. This material is easily machinable and is fabricated into a brazeable, hard vacuum assembly. The dielectric constant is essentially identical to quartz therefore requiring no significant microwave circuit re-design. The Thermal conductivity is approximately forty times better than that of quartz, and therefore eliminates the thermal run-away problems that occur in quartz vials in the area of plasma discharge. For example, the dielectric constant of quartz is 4 and that of hot, pressed boron nitride is 4.1. Further, the thermal conductivity of quartz is 0.0033 and that of hot, pressed boron nitride is 0.115 (cal.cm/sec $cm^2$ °C.). The diffusion coefficient, of chlorine gas into boron nitride, is less than that of chlorine into quartz. This helps to extend the life of the pre-TR stage since the gas cleanup rate is less.

Boron nitride vial 1 contains a halogen such as chlorine gas 2. It is noted as hereinbefore mentioned that the boron nitride is machined. The single FIGURE indicates some of the dimensions. It is also noted that sharp corners for vial 1 are avoided. The overall length is 12.40 inches. It is also helpful if the indicated 0.4000 inch surface is substantially parallel to the indicated 3.38 inches surface.

Two piece kovar heat sink 3 is brazed and fitted into a machined groove in boron nitride vial 1. Heat sink 3 may be placed against a water-cooled plate during operation of the pre-TR.

Surrounding boron nitride vial 1 at outer extremity is compression type metal container 4 which is in ceramic brazed-mode with heat sink braze. There is then kovar spinning-gold plating after the ceramic braze. Quartz reservoir 5 is positioned and fitted into compression type metal container 4. As completed vial 1, compression type metal container 4 are vacuum assemblies.

The single FIGURE illustrates the preferred design and replaces the quartz pre-TR stage for a high power receiver protector such as the Westinghouse WD 260. The kovar spinning and heat sink is brazed onto the machined boron nitride, and then glassing of the quartz reservoir to the spinning is performed.

During operation, the plasma generated heat is conducted axially through the boron nitride cylinder and then removed via the kovar heat sinks. These heat sinks are seated against a water cooled plate.

This pre-TR design allows the receiver protector to handle RF power in the range above 2 kW average at 50% duty.

We claim:

1. A high power pre-TR switch comprising
   a machined, hot pressed boron nitride vial,
   a reservoir vessel sealably connected thereto, said vial and said reservoir vessel defining a hermetically sealed enclosure,
   a halogen in said vial, and heat sink means affixed to said vial.

* * * * *